United States Patent [19]

Morrell

[11] Patent Number: 4,777,776

[45] Date of Patent: Oct. 18, 1988

[54] ROOF PANEL CONSTRUCTION

[76] Inventor: Chris Morrell, 2016 E. Sevier Ave., Kingsport, Tenn. 37664

[21] Appl. No.: 372,179

[22] Filed: Apr. 26, 1982

[51] Int. Cl.[4] ..... E04D 1/00

[52] U.S. Cl. ..... 52/531

[58] Field of Search ..... 52/519, 521, 529, 530, 52/545, 551, 331

[56] References Cited

U.S. PATENT DOCUMENTS

| | | | |
|---|---|---|---|
| 154,973 | 9/1874 | Wiles | 52/530 |
| 381,000 | 4/1888 | Determann | 52/530 |
| 453,707 | 6/1891 | Smyth | 52/531 |
| 466,198 | 12/1891 | Thorn | 52/530 |
| 468,484 | 2/1892 | Sagendorph | 52/530 |
| 955,855 | 4/1910 | Day | 52/531 |
| 968,887 | 8/1910 | Roth | 52/519 X |
| 1,073,485 | 9/1913 | Hames | 52/531 |
| 1,236,510 | 8/1917 | Wales | 52/551 X |
| 3,394,520 | 7/1968 | Skelton | 52/531 |
| 3,411,259 | 11/1968 | Anderson | 52/531 |
| 3,473,274 | 10/1969 | Godes | 52/531 |
| 3,813,318 | 4/1880 | Barker | 52/531 |
| 4,054,012 | 10/1977 | Paradisi et al. | 52/551 X |
| 4,104,841 | 8/1978 | Naz | 52/551 X |

FOREIGN PATENT DOCUMENTS

| | | | |
|---|---|---|---|
| 567161 | 10/1957 | Italy | 52/530 |
| 753076 | 7/1956 | United Kingdom | 52/519 |

*Primary Examiner*—John E. Murtagh

[57] ABSTRACT

Disclosed is roof panel construction, preferably of galvanized steel, aluminum, fiberglass reinforced plastic, and the like, comprising a substantially flat body of substantially parallelogrammatic configuration, first shoulder means adjacent a first edge of said body and extending substantially in a straight line across said body, said shoulder means extending outwardly from the plane of said body a distance approximately required to accomodate the thickness of an adjacent shoulder means, and then for a short distance away from said edge in a plane substantially parallel to the plane of said body to provide an opening, said shoulder means and said edge being spaced sufficiently along the plane of said body to provide an attachment tab, said shoulder means and said body being hermetically sealed at their juncture, and a second edge of said body substantially oppositely disposed to said first edge and provided with second shoulder means of essentially the same configuration as said first shoulder means but oppositely disposed with respect to the plane of said body with its opening facing in the opposite direction to the opening of said first shoulder means. This panel construction provides for overlapping, sealed roofing installation.

1 Claim, 1 Drawing Sheet

ROOF PANEL CONSTRUCTION

This invention concerns novel construction for roofing panels, preferably of galvanized steel, aluminum sheeting, of, for example, 18 gauge, or fiberglass reinforced plastic, which panels are of one piece, simple and yet sturdy construction which are adapted to overlap and seal against the weather by means of hidden attaching tabs. These panels are constructed to lie especially flat on the roof and form the weather seal by simple but effective means.

More specifically, the principal embodiment of the present invention comprises a substantially flat body of substantially parallelogrammatic configuration, first shoulder means adjacent a first edge of said body and extending substantially in a straight line across said body, preferably substantially parallel to said edge, said shoulder means extending outwardly from the plane of said body a distance approximately required to accommodate the thickness of an adjacent shoulder means, and then for a short distance away from said edge in a plane substantially parallel to the plane of said body to provide an opening, said shoulder means and said edge being spaced sufficiently along the plane of said body to provide an attachment tab, said shoulder means and said body being hermetically sealed at their juncture, and a second edge of said body substantially oppositely disposed to said first edge and provided with second shoulder means of essentially the same configuration as said first shoulder means but oppositely disposed with respect to the plane of said body with its opening facing in the opposite direction to the opening of said first shoulder means.

The invention will be further understood from the following description and drawing wherein.

Figure 1:
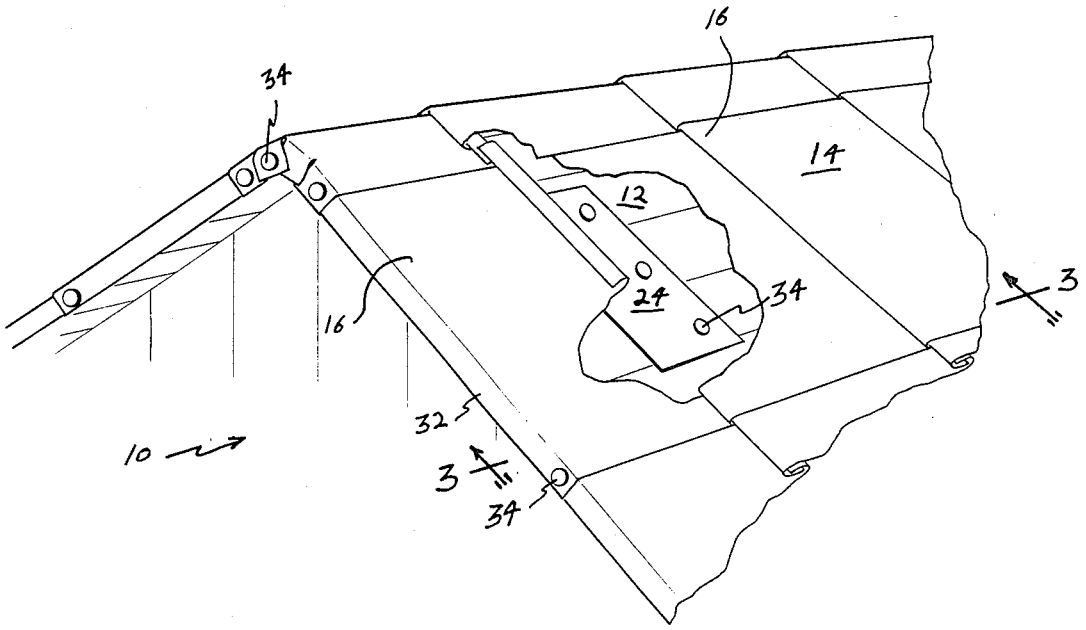
FIG. 1 is an isometric view of a barn roof with the present panels secured thereto and partially broken away to show the attaching tab in its assembled position.

Referring to the drawing, a barn or other structure 10, having a roof 12, typically of boards but also, e.g., of plywood sheets, is covered by the panels 14 of the present invention. These panels, in their principal embodiment comprise a substantially flat body 16 of substantially parallelogrammatic configuration having first shoulder means 18 adjacent a first edge 20 and preferably extending substantially in a straight line across said body substantially parallel to said edge, said shoulder means 18 extending outwardly from the plane of said body a distance approximately required to accommodate the thickness of an adjacent panel and then for a short distance away from said edge in a plane substantially parallel to the plane of said body to provide an opening 22, said shoulder means and said edge being spaced sufficiently along in the plane of said body to provide an attachment tab 24, said shoulder means and said body being hermetically sealed at their juncture 26. This juncture or joint 26 may be provided by integrally forming shoulder means 18 with the rest of the body, for example, as in the extrusion of aluminum or plastic sheet, or the joint may be formed adhesively, assisted by rivets or the like, or by welding, brazing, or other such means known to the art. This shoulder means preferably extends the full length or width of the body, depending on the shape of the panel in order to insure maximum sealing. Tab 24 may also extend the full width or length of the body, but it is preferred that it be cut short as shown in FIG. 1 at the areas of overlap at the top and bottom to avoid excessive thickness build-up.

The seal is completed for adjacent panels by the provision of a second edge 28 of said body substantially oppositely disposed to said first edge and provided with second shoulder means of essentially the same configuration as said first shoulder means but oppositely disposed with respect to the plane of said body with its opening 30 facing in the opposite direction to the opening 22 of said first shoulder means.

In another embodiment of the invention, the second edge 28 of said body substantially oppositely disposed to said first edge is, for the edgemost panels, provided with a flange 32 depending at substantially a right angle from the plane of said body in an opposite direction from the first shoulder means 18. In both embodiments, of course, the panels are held to the roof surface by means of shingle nails 34 or the like driven through tabs 24, which nails are hidden and sealed by virtue of the overlying bodies of adjacent panels.

Figure 2:
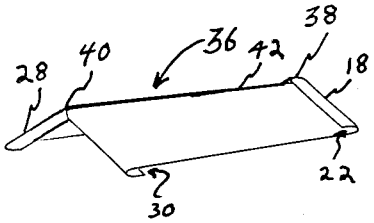
FIG. 2 is an isometric view of a preferred type of ridge panel which may be used with the present invention.
Figure 3:
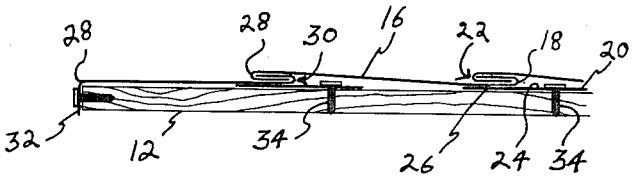
FIG. 3 is a cross-sectional view taken along line 3—3 of FIG. 1 in the direction of the arrows.

In FIG. 2 is shown a ridge panel 36 provided with shoulder means 18 and 28, as aforesaid, and may or may not be provided with tabs 24. The adjacent and lower panels and the adjacent ridge panels will keep these ridge panels in position without nailing, although it is preferred to secure the edgemost one as shown in FIG. 1, and to provide attachment tabs.

The present panels are applied to the roof, as depicted in the drawing, by first securing the lower, left-hand corner panel and then progressing lengthwise of the roof to lay the "first course." This operation is then repeated on the next course up the roof, with any desired vertical overlap, such as 3–4 inches, depending on the overall size of the panels. It is particularly noted that the present panels require no special or complex installation procedures such as for panels requiring a central lap section or rib, or the like. It is further noted that an important aspect of the present invention is that the same panels can be layed on the opposite side of peaked roofs such that the lap joint can be made from the same direction and allow the use of the ridge panels as shown in FIG. 2 wherein the ridge lap joint is made from the same direction for both sides of the roof.

The present panels further offer unique simplicity of construction, function, and appearance by virtue of the essentially planar relationship of each panel to the other which is brought about by the present construction wherein the aforesaid openings 22 and 30 are designed to receive an adjacent shoulder with substantially a sliding fit. It is further noted, as shown in FIG. 2, that in the most preferred embodiment of the ridge panel 36, both of its shoulder means at the apices 38 and 40 thereof are integral (unsplit) which is achieved during formation of the ridge 42 by confining said apices in a suitable die such that upon bending the panel to form said ridge, the openings 22 and 30 are not closed off at said apices. This feature further insures weatherproofing at the roof ridge where the most severe weathering is apt to occur. In this regard, this most preferred ridge panel construction also utilizes the attaching tab 24, not shown in FIG. 2.

The invention has been described in detail with particular reference to preferred embodiments thereof, but it will be understood that variations and modifications can be effected within the spirit and scope of the invention.

I claim:

1. A metal roofing construction covering a roof, comprising a plurality of horizontally and vertically overlapping courses of roof panels, each of said panels comprising a substantially flat body of substantially parrallellogrammatic configuration, first shoulder means adjacent a first vertical edge of said body and extending substantially in a straight line vertically across said body, said shoulder means extending outwardly from the plane of said body a distance approximately required to accomodate the thickness of an adjacent second shoulder means, and then for a short distance horizontally away from said edge in a plane substantially parallel to the plane of said body to provide an opening for said second shoulder means, said first shoulder means and said edge being horizontally spaced sufficiently along the horizontal plane of said body to provide an attachment tab, means extending through said tab and into said roof for securing said panel thereto, said first shoulder means and said body being hermetically sealed at their juncture, a second vertical edge of said body substantially oppositely disposed to said first edge and provided with said second vertical shoulder means of essentially the same configuration as said first shoulder means but oppositely disposed with respect to the plane of said body and with its opening facing in the opposite direction to the opening of said first shoulder means, and each of said panels being sealed in a horizontal course by means of its first shoulder means being nested with the second shoulder means of an adjacent panel, and by means of its second shoulder means being nested with the first shoulder means of another adjacent panel.

* * * * *